US009456673B2

(12) United States Patent
Chang

(10) Patent No.: US 9,456,673 B2
(45) Date of Patent: Oct. 4, 2016

(54) FLUID SEALABLE PROTECTIVE CASE FOR PORTABLE ELECTRONIC DEVICES

(71) Applicant: David Chang, Houston, TX (US)

(72) Inventor: David Chang, Houston, TX (US)

( * ) Notice: Subject to any disclaimer, the term of this patent is extended or adjusted under 35 U.S.C. 154(b) by 127 days.

(21) Appl. No.: 14/084,561

(22) Filed: Nov. 19, 2013

(65) Prior Publication Data

US 2014/0346078 A1 Nov. 27, 2014

Related U.S. Application Data

(60) Provisional application No. 61/826,770, filed on May 23, 2013.

(51) Int. Cl.

| | |
|---|---|
| ***B65D 85/00*** | (2006.01) |
| ***A45C 11/00*** | (2006.01) |
| ***A45C 11/22*** | (2006.01) |
| ***A45C 13/00*** | (2006.01) |

(52) U.S. Cl.

CPC ..... *A45C 11/00* (2013.01); *A45C 11/22* (2013.01); *A45C 13/008* (2013.01); *A45C 2011/002* (2013.01)

(58) Field of Classification Search

CPC .... A45C 11/00; A45C 11/22; A45C 13/008; A45C 2011/002

USPC ..... 206/37, 38, 320; 53/467, 472; 361/679.55, 679.56; 455/575.1, 575.8

See application file for complete search history.

(56) References Cited

U.S. PATENT DOCUMENTS

| | | | | |
|---|---|---|---|---|
| 8,191,706 | B1 * | 6/2012 | Liu | G06F 1/1628 206/320 |
| 8,342,325 | B2 | 1/2013 | Rayner | |
| 8,644,011 | B2 * | 2/2014 | Parkinson | B29C 33/485 455/575.1 |
| 2012/0118773 | A1 | 5/2012 | Rayner | |
| 2012/0211382 | A1 | 8/2012 | Rayner | |
| 2012/0314354 | A1 | 12/2012 | Rayner | |
| 2013/0027862 | A1 | 1/2013 | Rayner | |
| 2013/0043777 | A1 | 2/2013 | Rayner | |
| 2013/0077226 | A1 | 3/2013 | Rayner | |
| 2013/0088130 | A1 | 4/2013 | Rayner | |
| 2013/0088828 | A1 | 4/2013 | Rayner | |
| 2013/0092576 | A1 | 4/2013 | Rayner | |
| 2013/0126372 | A1 * | 5/2013 | Song | G06F 1/1626 206/320 |
| 2013/0175186 | A1 * | 7/2013 | Simmer | A45C 11/00 206/37 |
| 2013/0334071 | A1 * | 12/2013 | Carnevali | H05K 5/03 206/37 |
| 2014/0116895 | A1 * | 5/2014 | Ellenburg | H04B 1/3888 206/37 |
| 2014/0246339 | A1 * | 9/2014 | Chung | H04B 1/3888 206/37 |
| 2014/0262847 | A1 * | 9/2014 | Yang | A45C 11/00 206/37 |
| 2014/0339104 | A1 * | 11/2014 | Magness | A45C 11/00 206/37 |

* cited by examiner

*Primary Examiner* — Luan K Bui

(74) *Attorney, Agent, or Firm* — Buche & Associates, P.C.; John K. Buche; Bryce A. Johnson

(57) ABSTRACT

The present application is directed to a protective case for a portable electronic device, including a back cover and a front cover for housing a portable electronic device therein, wherein the back cover and the front cover include one or more mating surfaces operationally configured to fluidly seal the perimeter of the protective case.

13 Claims, 9 Drawing Sheets

FLUID SEALABLE PROTECTIVE CASE FOR PORTABLE ELECTRONIC DEVICES

CROSS-REFERENCE TO RELATED APPLICATIONS

This application claims the benefit of provisional patent application No. 61/826,770 filed on May 23, 2013.

STATEMENT REGARDING FEDERALLY SPONSORED RESEARCH OR DEVELOPMENT

Not applicable.

FIELD OF THE APPLICATION

The application relates generally to fluid sealable protective cases and containers for portable electronic devices such as smartphones, tablet computers, and the like.

BACKGROUND

Protective cases are often used with items such as portable electronic devices to protect against damage resulting from various impacts, e.g., dropping, scratching or hitting the device. Many types of portable electronic devices exist that employ protective cases including, but not necessarily limited to personal digital assistants (PDAs), computers, smartphones, mobile phones, notebooks, calculators, satellite phones, cellular phones, pagers, music player, MP3 players, media players, digital cameras, video cameras, bar code scanner, global positioning systems (GPS), and portable game consoles. Due to the cost of many of these devices, it is also often desirable to protect against environmental damage such as exposure to moisture, electromagnetic radiation, one or more chemicals, and underwater pressure to provide waterproof functionality.

Commercially available protective cases designed as waterproof cases employ various materials and removable seals or gasket materials to assist in sealing an electronic device within the case. Known case materials are subject to leakage and removable seals or gasket material often deform, come apart from the protective case, break down, and/or lose their sealing ability over time. A protective case that overcomes the above shortcomings is desired.

SUMMARY

The present application is directed to a protective case for a portable electronic device, including a back cover and a front cover for housing a portable electronic device therein, wherein the back cover and the front cover include one or more mating surfaces operationally configured to fluidly seal the perimeter of the protective case.

The present application is also directed to A protective case for a smartphone, including a back cover and a front cover for housing a smartphone therein; wherein the back cover includes an outer surface member constructed from one or more non-resilient materials and an inner surface member constructed from one or more resilient materials; wherein the front cover includes a perimeter member constructed from one or more non-resilient materials and a side member constructed from one or more substantially resilient materials.

The present application is also directed to A method of isolating an electronic device from ambient fluids, including (1) providing a protective case for sealably housing an electronic device therein, the protective case having a back cover and a front cover with one or more mating surfaces operationally configured to fluidly seal the perimeter of the protective case when housing an electronic device therein; and (2) placing an electronic device between the back and front covers and locking the back cover to the front cover.

DESCRIPTION

Figure 1:
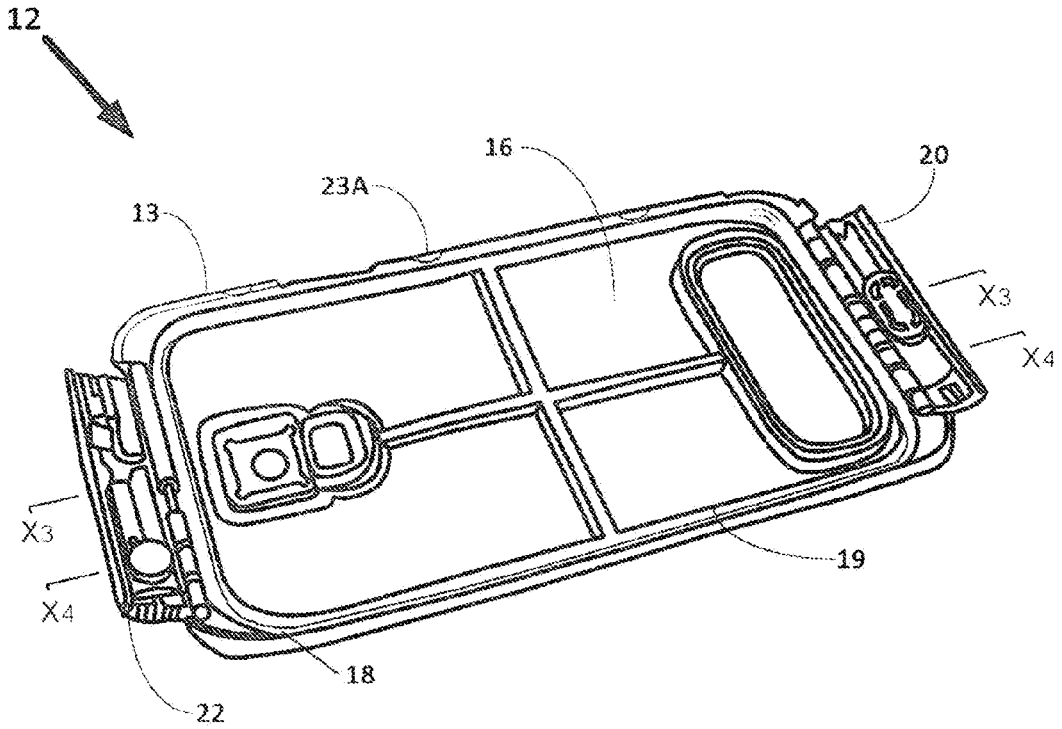
FIG. 1 is a perspective view of a first member of a protective case of the present application.

Before describing the invention in detail, it is to be understood that the present protective case and method are not limited to particular embodiments. It is also to be understood that the terminology used herein is for the purpose of describing particular embodiments only, and is not intended to be limiting. As used in this specification and the appended claims, the term "fluid" is defined as any form of liquid and/or gas, separately or mixed. As used herein, "resilient" refers to a material's ability to return to its original form or position after being deformed when used in normal operation.

In one aspect, the application provides a protective case having a first member and a second member that when assembled together fluidly seal a portable electronic device therein while maintaining user operability of the portable electronic device. Suitably, the protective case may be operationally configured to fluidly seal a portable electronic device therein without the use of gaskets or other removable seals.

In another aspect, the application provides a two part protective case effective for housing a portable electronic device against moisture, underwater pressure and various dry chemicals including air-borne chemicals and/or fluid based chemicals. Suitably, the protective case has mating surfaces that are operationally configured to maintain their structural integrity upon exposure to one or more industrial and/or environmental components or influences.

In another aspect, the protective case may include a back cover and a front cover for housing a portable electronic device therein. The back cover and front cover may include one or more mating surfaces constructed from (1) one or more resilient and (2) one or more non-resilient materials operationally configured to fluidly seal a portable electronic device within the protective case. In another embodiment, the one or more resilient materials may provide shock absorbing qualities to the protective case upon impacts to the outer surface of the case.

In another aspect, the application provides a fluidly sealable protective case including one or more apertures there through operationally configured to work in conjunction with interactive features typically found on commercially available smartphones including, but not necessarily limited to speakers, audible receivers, microphones, camera lenses, camera flashes, and combinations thereof.

In another aspect, the application provides a protective case for a portable electronic device operationally configured to maintain a fluid seal up to a depth of about 2.0 meters (about 6.56 feet) below water's surface for a duration of about 30.0 minutes.

In another aspect, the application provides a protective case having a first member and a second member operationally configured to house a portable electronic device therein. The first member and second members include multiple mating surfaces along their perimeters operationally configured to abut in a manner effective to fluidly seal a portable electronic device within the protective case under liquid pressure.

In another aspect, the application provides a protective case having a first member and a second member operationally configured to house a portable electronic device therein, the first member having a perimeter defined by a groove or channel constructed from one or more first materials, the second member having a ridge along its perimeter operationally configured to engage the channel of the first member when the first and second members are mated for the purpose of sealing a portable electronic device between the first and second members, the ridge being constructed from one or more materials unlike the one or more first materials in chemical composition and/or resiliency.

In another aspect, the application provides a fluidly sealable protective case with first and second members constructed from one or more materials providing one or more compressible mating surfaces and one or more mating rigid surfaces. In another aspect, the first member and second member include form fitting sealable engaging surfaces.

In another aspect, the application provides a water sealable protective case including a front cover and a back cover held together during operation via clasps at opposing ends of the protective case and/or hook type members disposed along the sides of the front cover and/or the back cover.

In another aspect, the application provides a protective case for one or more portable electronic devices. The protective case has a front cover and a back cover, each cover having one or more sealable surfaces wherein at least one cover has one or more sealable surfaces corresponding to one or more surface features of an electronic device to be housed within the protective case.

In another aspect, the application provides a protective case for fluidly sealing one or more portable electronic devices therein. Suitably, the protective case includes a front cover and back cover, each cover having at least one sealable surface for engaging a surface of the opposing cover. Sealable surfaces of the front and back covers may include substantially planar surfaces and/or non-planar surfaces. In an embodiment including a plurality of substantially planar sealable surfaces it is contemplated that the planes defining two or more surfaces may lie in substantially parallel alignment and/or substantially perpendicular alignment and/or substantially planar sealable surfaces may lie along two or more non-perpendicular and/or non-parallel planes.

In another aspect, the application provides a protective case operationally configured to house objects in addition to portable electronic devices. For example, the protective case may house other naturally occurring or manufactured items regardless of the materials of manufacture. In addition, the protective case may include a shape to accommodate one or more particular shaped items to be housed therein. As such, the protective case may be built to scale. As an example, the protective case may function as a medicine container, a biochemical container, a transport shipping container, a suitcase type item, a food or drink container, or any other form of protective case meant to house object(s) and prevent the objects from being damaged due to exposure to liquid, one or more environmental factors and/or mishandling of the protective case.

DISCUSSION

To better understand the novelty of the protective case and use thereof, reference is hereafter made to the accompanying drawings. With reference to FIGS. 1-4, a simplified illustration of an exemplary protective case 10 is provided. As shown, the protective case 10 includes a first member 12 or back cover operationally configured to cover a back surface of a portable electronic device (see FIGS. 1 and 2) and a second member 14 or front cover operationally configured to cover a front surface of a portable electronic device (see FIGS. 3 and 4). Suitably, the first and second members 12, 14 are operationally configured to fluidly seal and isolate a portable electronic device (hereafter "device") from the ambient environment external to the protective case 10.

Figure 2:
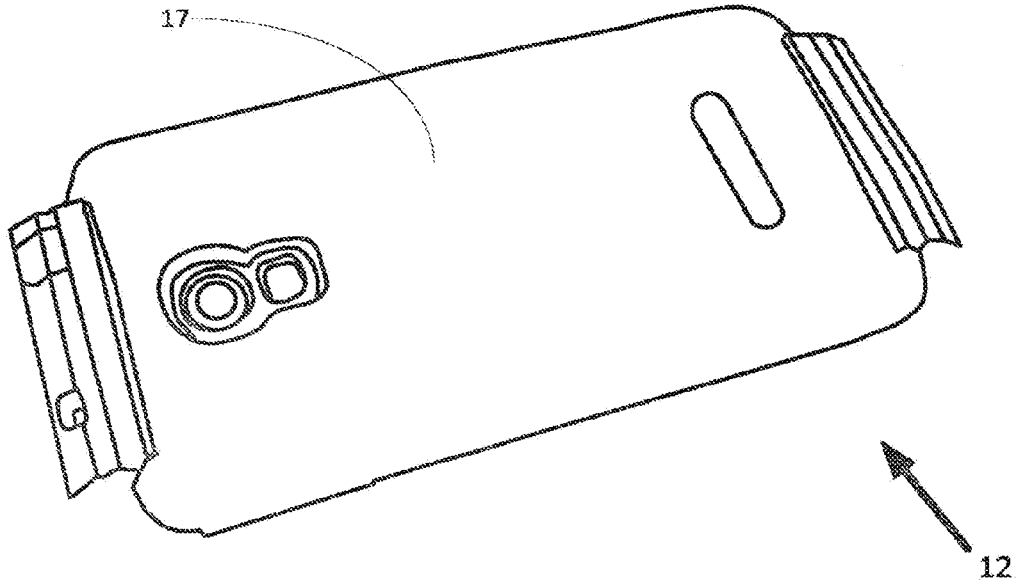
FIG. 2 is a perspective view of the opposite side of the first member of FIG. 1.

As shown in FIGS. 1 and 2, the first member 12 includes an inner surface 16 and an outer surface 17. The inner surface 16 is defined by an outer edge 13, a raised surface section 19 and a channel 18 disposed there between along or near the perimeter of the inner surface 16. As seen in FIG. 1, the raised surface section 19 further separates the inner surface 16 from the channel 18 surface of the first member 12. Relative to the outer edge 13, the inner surface 16 may lie at a depth about equal to the depth of the innermost surface of the channel 18. In another embodiment, the innermost surface of the channel 18 may lie at a depth greater than the inner surface 16. In another embodiment, the innermost surface of the channel 18 may lie at a depth less than the inner surface 16.

The first and second members 12, 14 may further include one or more corresponding attachment members along the sides and/or at one or both of the ends of the members 12, 14. As depicted in FIGS. 1 and 2, an attachment member may be provided in the form of a first clasp 20 and a second clasp 22 at opposing ends operationally configured to assist in fluidly sealing the ends of the protective case 10 and/or maintain the first and second members 12, 14 in an attached orientation during operation of the protective case 10. Likewise, the first and second members 12, 14 may include one or more corresponding interlocking members 23A and 23B (FIGS. 1 and 3) along the sides of the first and second members 12, 14. Suitably, the interlocking members 23A and 23B are operationally configured to assist in fluidly sealing the sides of the protective case 10 and/or maintaining the first and second members 12, 14 in an attached orientation during operation of the protective case 10.

In addition, the surface configuration of the protective case 10 may be determined according to the surface configuration and/or user input/output features and/or user interface(s) of one or more devices to be housed within the protective case 10. Without limiting the invention, the protective case 10 will be described here forward in terms of housing a device such as a smartphone 100 as the term is understood by those of ordinary skill in the art of cellular phones.

Figure 3:
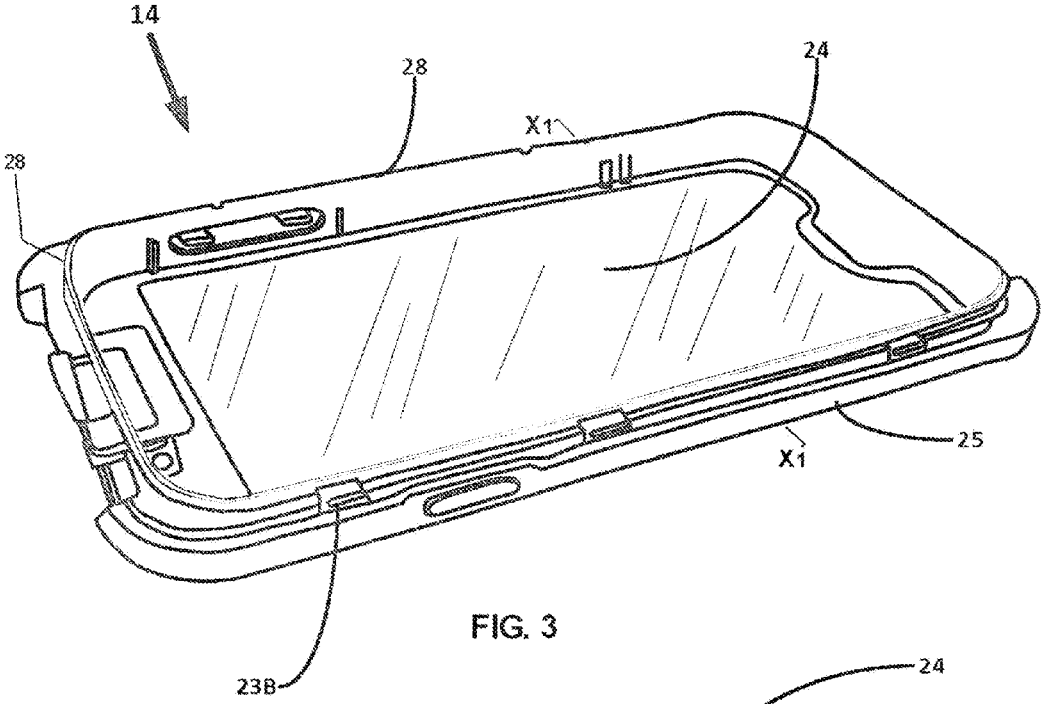
FIG. 3 is a perspective view of a second member of a protective case.
Figure 4:
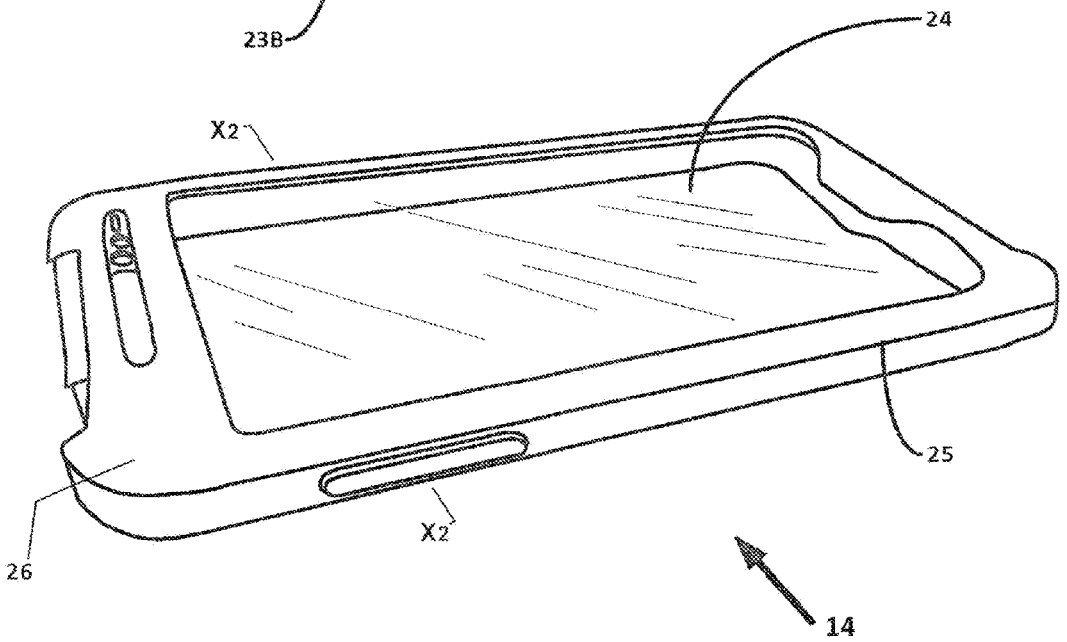
FIG. 4 is a perspective view of the opposite side of the second member of FIG. 3.

Turning to FIGS. 3 and 4, the second member 14 suitably includes an interactive cover member 24 ("interactive cover") comprising a transparent water sealable type material for accessing the touch screen of a smartphone 100 housed within the protective case 10. The interactive cover 24 is suitably bordered by a perimeter member 25 including an outer surface section 26 of the second member 14. As shown in FIG. 4, the outer surface section 26 and the interactive cover 24 comprise the front outer surface of the protective case 10.

In the embodiment of FIG. 3, the inner surface of the perimeter member 25 includes a raised circumferential ridge, wall or rim type member 28 ("ridge") disposed along or near the perimeter of the second member 14, the ridge 28 includes substantially the same shape as the corresponding channel 18 of the first member 12. As discussed in detail below, the ridge 28 is operationally configured to engage the channel 18 when the first member and second member 12, 14 are brought together to enclose a smartphone 100 therein. Thus, the outer width of the ridge 28 suitably corresponds to the width of the channel 18 ensuring a sealable fit during operation of the protective case 10.

Figure 5:
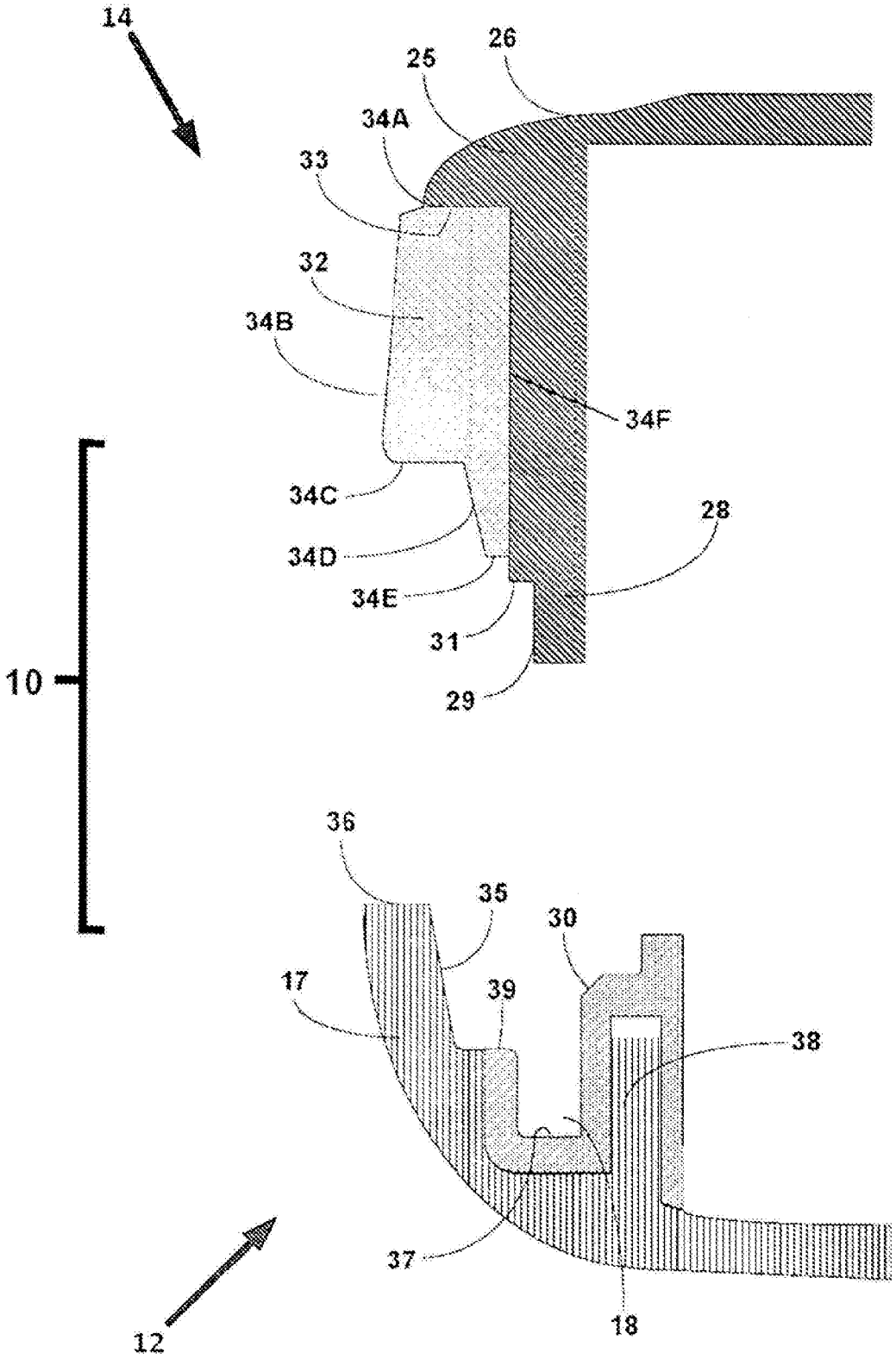
FIG. 5 is a sectional view of an example of the sides of the first and second members.

Turning to FIG. 5, a simplified illustration of an embodiment of the mating surfaces of a side edge of the perimeter of the protective case 10 is provided. As shown, the first member 12 includes an outer surface member 17, which is suitably constructed from one or more substantially rigid type and/or semi-rigid type materials and an inner surface section 30 attached thereto constructed from one or more resilient and/or semi-resilient materials. In another embodiment, the inner surface section 30 may be constructed from a combination of one or more substantially rigid type and/or semi-rigid type materials and one or more resilient and/or semi-resilient materials including an outer most surface comprising one or more resilient and/or semi-resilient materials. It is also contemplated that the outer surface member 17 may include an outermost layer constructed from one or more rigid type and/or semi-rigid type materials different from the material(s) used to construct the remaining inner layer(s) of the outer surface member 17.

Regardless the material make-up of the first member 12, the inner surface member 30 is suitably constructed from one or more materials operationally configured to receive the second member 14 in a manner effective to fluidly seal an electronic device therein. More particularly, the inner surface member 30 is suitably operationally configured to receive the ridge 28 of the second member 14 in a manner effective to form a fluid seal there between.

Still referring to FIG. 5. the second member 14 suitably includes a perimeter member 25 and a side member 32 attached thereto. The outer perimeter surface 26 of the perimeter member 25 is suitably constructed from one or more substantially rigid type and/or semi-rigid type materials and the side member 32 is suitably constructed from one or more resilient and/or semi-resilient materials. In another embodiment, the outer perimeter surface 26 may be constructed from a combination of one or more substantially rigid type and/or semi-rigid type materials and one or more resilient and/or semi-resilient materials. Likewise, the side member 32 may be constructed from a combination of one or more substantially rigid type and/or semi-rigid type materials and one or more resilient or semi-resilient materials including an outer most surface comprising one or more resilient and/or semi-resilient materials. In still another embodiment, the second member 14 may be defined by a continuous one-piece material as opposed to comprising separate parts and/or materials for forming an engagement surface with a corresponding first member 12.

As shown, the side member 32 is suitably attached to at least part of the ridge 28, the side member 32 suitably forming a resilient outer side wall type surface of the second member 14. In the embodiment of FIG. 5, the outer surface of the side member 32 suitably includes faces 34A-34F including two faces operationally configure to abut the perimeter member 25. Other side member 32 configurations are herein contemplated.

Suitably, the outer perimeter surface 26 includes a lip 33 in abutment with the first face 34A of the side member 32. The lip 33 is suitably operationally configured to restrict movement of the side member 32 away from the first member 12 and assist in keeping the side member 32 from detaching from the outer perimeter surface 26 when the second member 14 engages the first member 12 during operation of the protective case 10. The side member 32 also includes one or more faces 34C-34E operationally configured to sealably engage at least part of the first member 12.

As will be described and illustrated in more detail below, the outer surface member 17 of the first member 12 suitably includes an inner surface 35 and a face 36 operationally configured to sealably abut at least part of the side member 32 during operation of the protective case 10. Without limiting the invention, the outer surface 17 configuration is not necessarily limited, however a surface configuration is desired for optimizing sealable engagement with a corresponding second member 14.

In addition, the inner surface member 30 suitably includes a surface configuration effective to sealably engage at least the ridge 28 of the perimeter member 25. In the simplified embodiment of FIG. 5, the outer surface 17 includes a raised member 38 projecting out in a manner effective to form an engagement surface for the inner surface member 30 whereby part of the inner surface member 30 is disposed between the raised member 38 and the inner surface 35 of the outer surface 17 forming a channel 18 effective to receive a corresponding ridge 28 in sealable engagement thereto. As further shown, the inner surface member 30 may abut two or more sides of the raised member 38 for purposes of structural support of the first member 12 and/or providing an additional sealable surface of the protective case 10.

Still referring to FIG. 5, in an embodiment where the distal end of the ridge 28 is squared off (or is otherwise defined by corner edges), the corresponding channel 18 may include an inner surface 37 configuration including corners corresponding to the distal end of the ridge 28 whereby the outer surface 29 of the ridge 28 abuts the inner surface 37. In another embodiment, including a ridge 28 having a curved distal end, the inner surface 37 of the channel 18 may include a concave type surface effective for abutment of substantially the entire outer surface 29 of the distal end of the ridge 28 with the inner surface 37. In another embodiment, including a ridge 28 having a concave distal end, the inner surface 37 of the channel 18 may include a convex type surface effective for abutment of substantially the entire outer surface 29 of the distal end of the ridge 28 with the inner surface 37. It is also contemplated that in another embodiment, the surface configuration of the ridge 28 and inner surface 37 may be dissimilar and still provide a fluid seal there between whereby the resilient and/or semi-resilient material(s) making up the inner surface 37 is effective to deform into a shape suitable to abut the outer surface 29 of the ridge 28 during operation of the protective case 10. As further shown in FIG. 5, the ridge 28 may include a lip 31 operationally configured to engage face 39 of the inner surface member 30.

Figure 6:
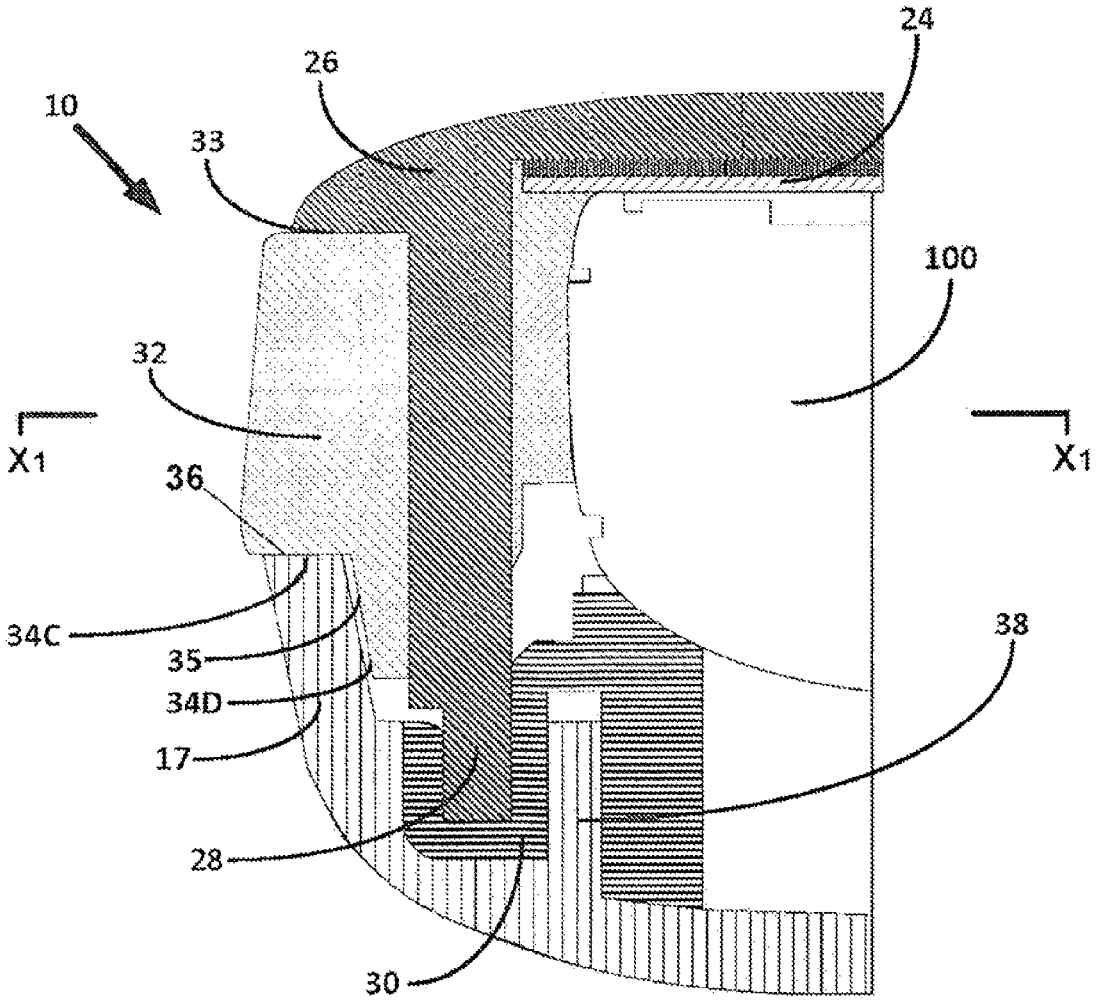
FIG. 6 is a sectional view of an example of the sides of the first and second members in sealable engagement.

In the simplified illustration of FIG. 6, the first and second members 12, 14 of FIG. 5 are shown in sealable engagement including a smartphone 100 housed therein. At a minimum, the first member 12 and second member 14 provide for fluidly sealable engagement near the outer surface of the protective case 10. In one example, the protective case 10 may provide a fluid seal via the engagement of the face 34C of the side member 32 with the face 36 of the first member 12. The protective case 10 may also provide a seal via the engagement of the face 34D of the second member 14 with the inner surface 35 of the outer surface 17.

Figure 7:
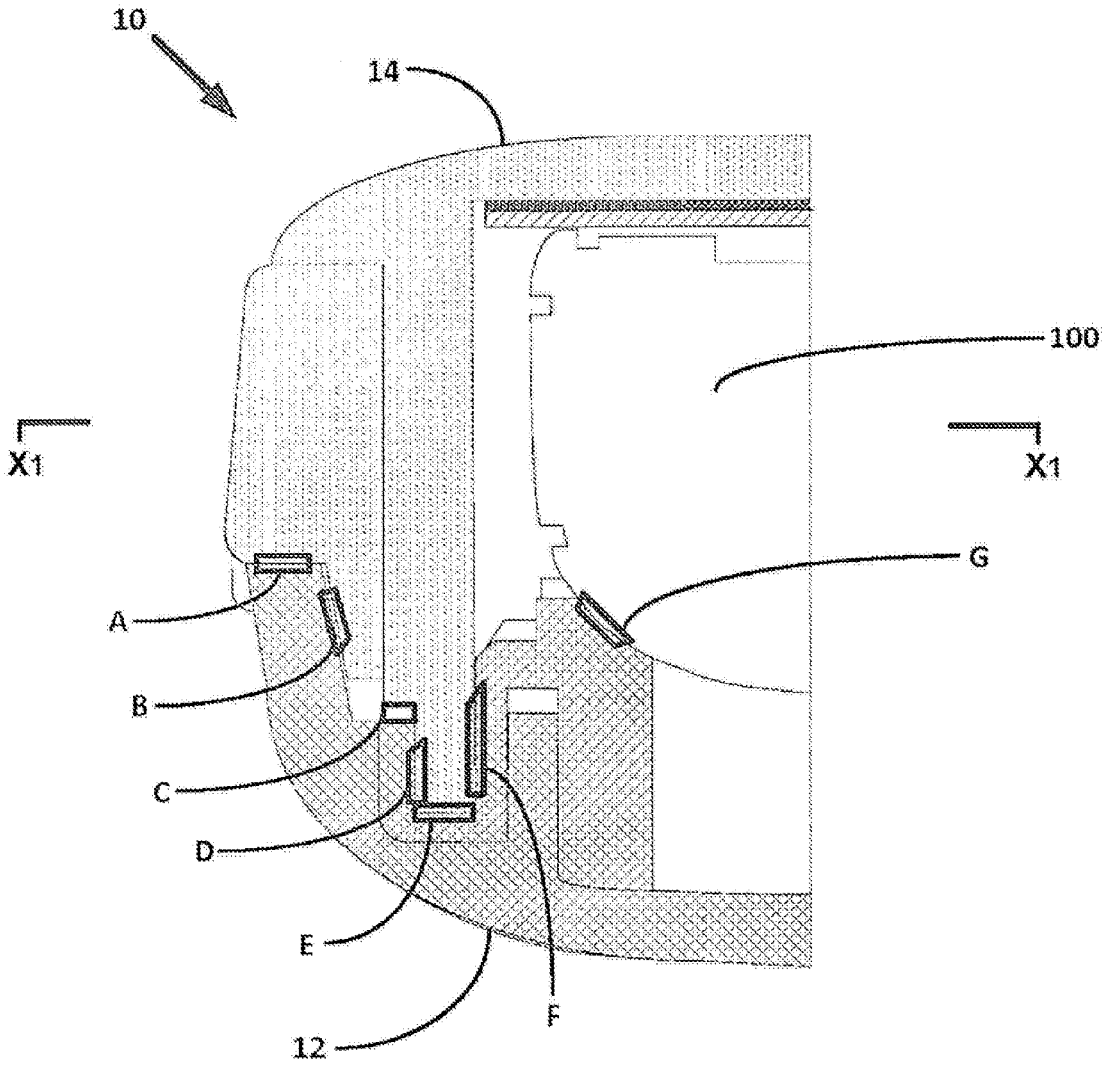
FIG. 7 is another sectional view of an example of the sides of the first and second members in sealable engagement.

Without limiting the invention to a particular embodiment, the protective case 10 of FIG. 6 suitably includes (1) at least six sealable surfaces defining points of engagement between the first and second members 12, 14 and at least one sealable surface defining a point of engagement between the first member 12 and a smartphone 100 housed within the protective case 10 (see sealable surfaces of engagement A-G in FIG. 7). As FIG. 7 illustrates, the first and second members 12, 14 have corresponding sealable surfaces lying along a plurality of planes—some surfaces being substantially planarly perpendicular to one another, some surfaces being substantially planarly parallel to one another and some surfaces being neither substantially planarly perpendicular or parallel to the other sealable surfaces of the first and second members 12, 14.

Figure 8:
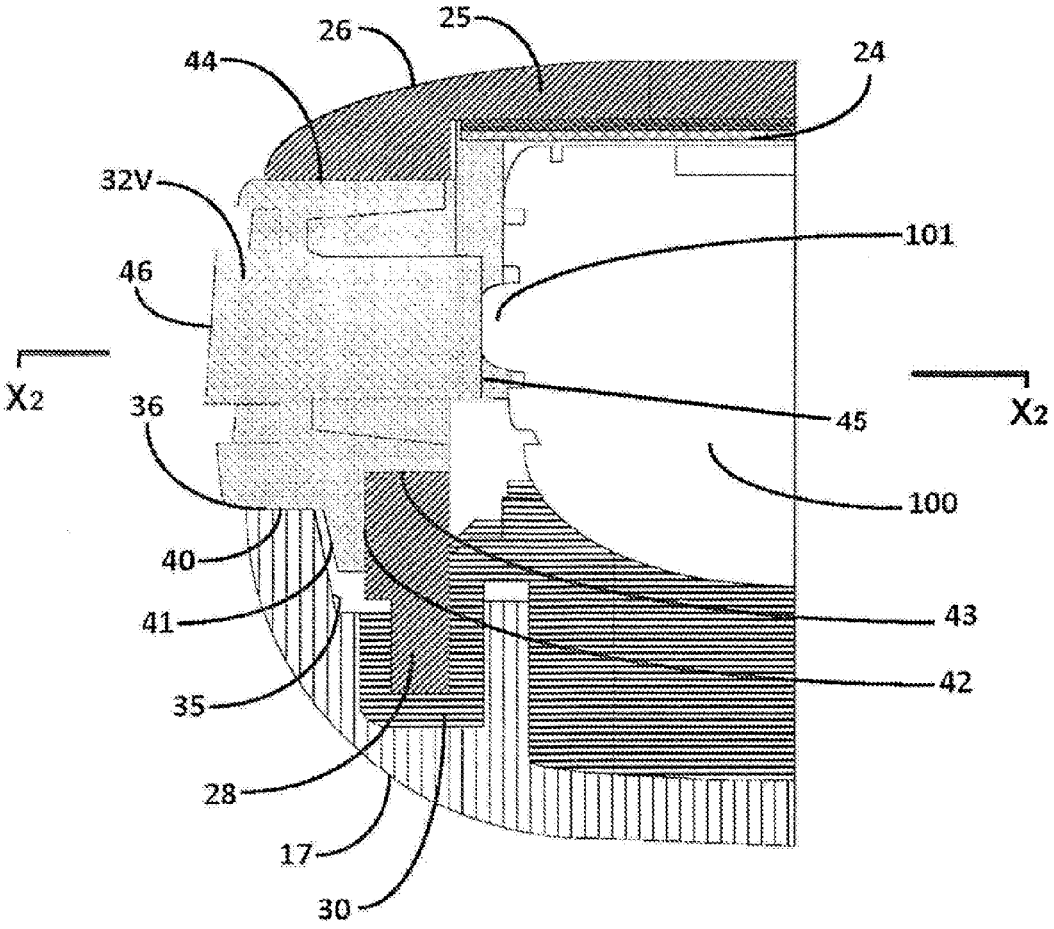
FIG. 8 is a sectional view of an example of the sides of the first and second members in sealable engagement at or near a volume control of a smartphone housed therein.

The protective case 10 may also include other configurations of sealable surfaces along the side edges of the first and second members 12, 14 according to one or more input/output features of a device 100 to be housed within the protective case 10. As shown in FIG. 8, for example, where the protective case 10 is configured to sealably house a smartphone 100, the side edges of the first and second members 12, 14 may include a unique sealable surface configuration in the locale or vicinity of a volume control or other input/output feature. As desired, the sealable surface configuration of the first and second members 12, 14 may be operationally configured to allow a user to communicate with a smartphone's input/output feature via direct manual contact of the protective case 10 without compromising the sealing of the protective case 10.

In the simplified example of FIG. 8, including first and second members 12, 14 corresponding to the volume control 101 of a smartphone 100, the second member 14 suitably includes a side section variant 32V operationally configured to (1) form a fluid seal with the outer surface 17 of the first member 12 and (2) provide user communication with the volume control 101 of a smartphone 100 housed within the protective case 10. Suitably, the side section variant 32V may be constructed from one or more resilient and/or semi-resilient materials effective to maintain a desired fluid seal and allow for manual operation of the volume control 101 housed within the protective case 10. In another embodiment, a side section variant 32V may be constructed from a combination of one or more substantially rigid type and/or semi-rigid type materials and one or more resilient or semi-resilient materials including an outer most surface comprising one or more resilient and/or semi-resilient materials as desired.

In operation, a surface 40 of the side section variant 32V may sealably engage the face 36 of the outer surface 17 in like manner as face 34C of the side section 32 as described above. In addition, a second surface 41 of the side section variant 32V may sealably engage the inner surface 35 of the outer surface 17. The side section variant 32V may also include substantially planar surfaces 42 and 43 operationally configured to form a seal along portions of the ridge 28 as shown. The side section variant 32V may also include another surface 44 for forming a seal with the perimeter member 25 and a surface 45 operationally configured to engage the volume control 101 to provide for manual communication of the volume control 101 along the outer surface of the side section variant 32V. For example, a user may press or otherwise contact the outer surface 46 of the side section variant 32V whereby the side section variant 32V is directed toward the volume control 101 of the smartphone 100 acting on the volume control 101 as desired. As shown in FIG. 8, the first and second members 12, 14 may include a plurality of surfaces operationally configured to form sealable points of engagement between the first and second members 12, 14 at or near the volume control 101 of a smartphone 100.

Figure 9:
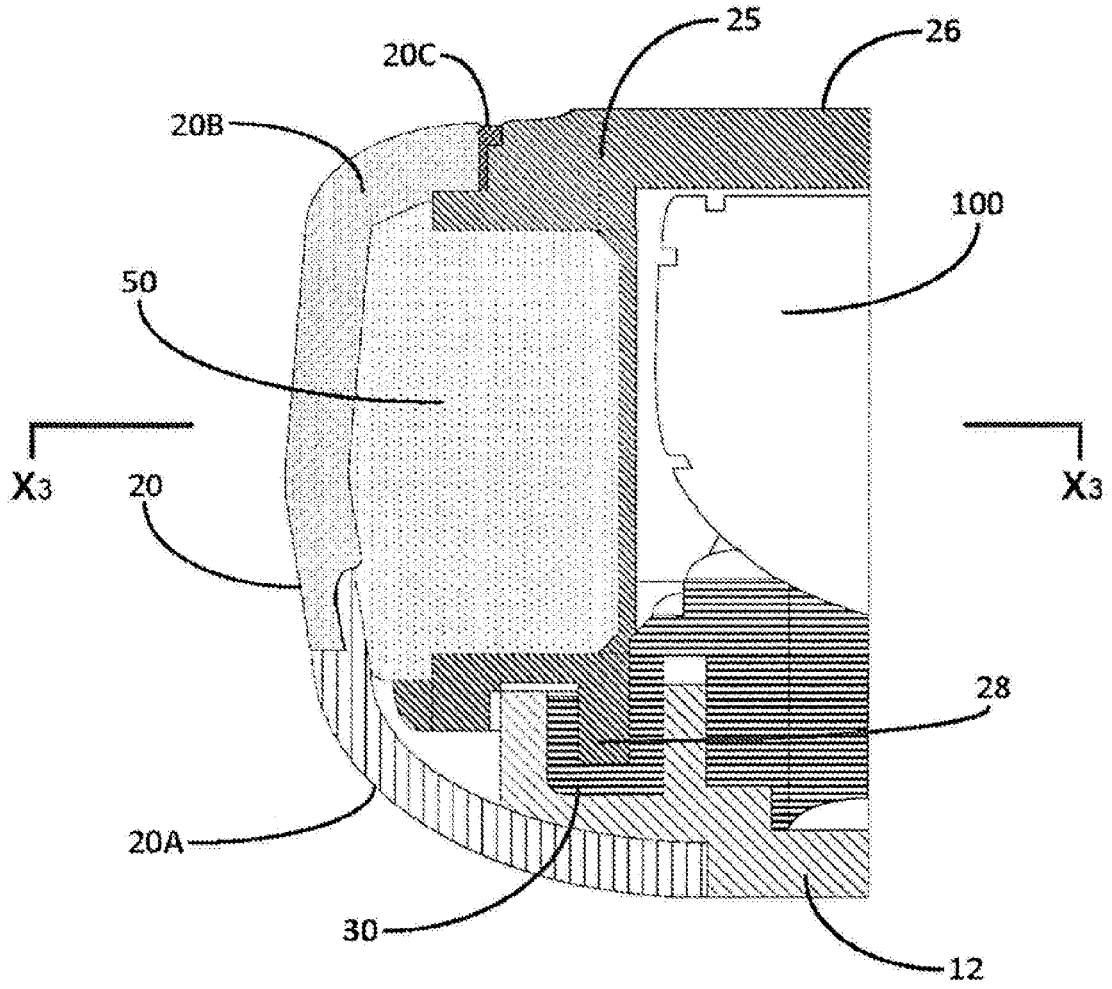
FIG. 9 is a sectional view of a first clasp at a first end of the protective case.

Turning to FIG. 9, a sectional view of an exemplary first clasp 20 of the protective case 10 is provided. As shown, the first clasp 20 may include a first part 20A constructed from one or more resilient and/or semi-resilient materials and a second part 20B constructed from one or more rigid materials and/or resilient materials and/or one or more semi-resilient materials. As shown, the second part 20B includes a distal end 20C operationally configured to sealably engage the perimeter member 25 along one or more surfaces. Suitably, the first part 20A is constructed from one or more malleable or flexible materials operationally configured to allow the first clasp 20 to open and close—flexing or bending about its point of attachment to the first member 12. As shown in this example, attached to the inner surface of the first clasp 20 is a plug 50 operationally configured to sealably engage a Universal Serial Bus ("USB") port of a smartphone 100. Without limiting the invention, a suitable plug 50 may be constructed from one or more resilient materials and/or semi-resilient materials. In operation, the plug 50 suitably forms a fluid seal with the second member 14, which may be provided with an aperture for receiving the plug 50 there through or a cavity for receiving the plug 50 therein.

Figure 10:
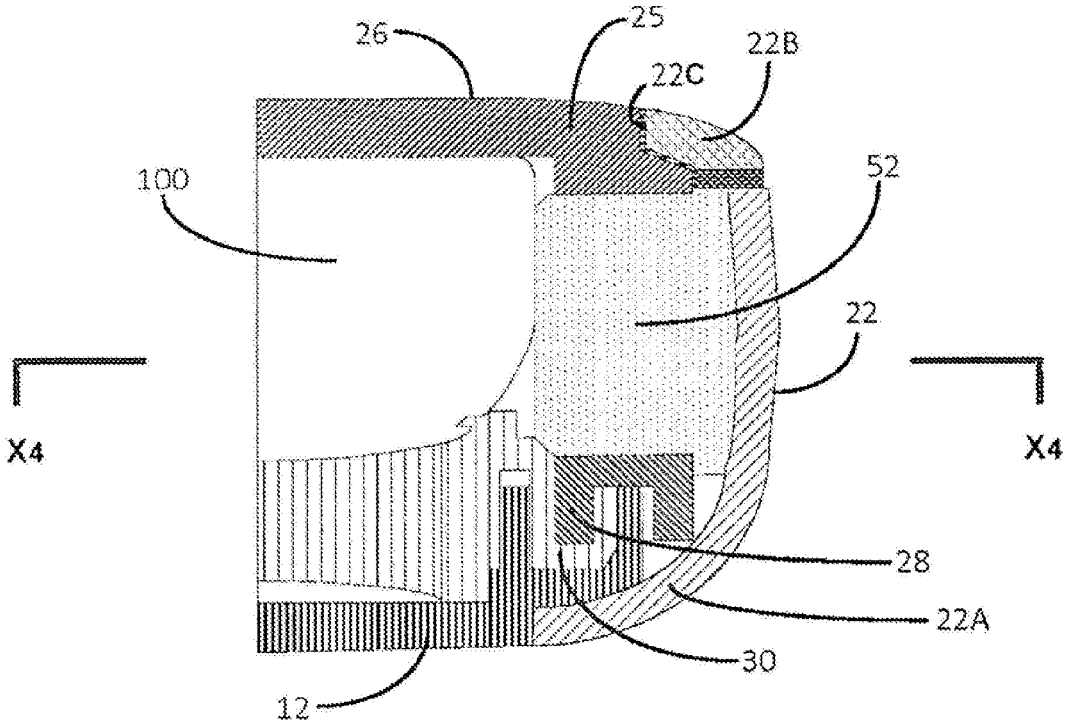
FIG. 10 is a sectional view of a second clasp at a second end of the protective case.

A simplified illustration of the opposing end of the protective case 10 is depicted in FIG. 10, including a sectional view of an exemplary second clasp 22. As shown, the second clasp 22 may include a first part 22A constructed from one or more resilient materials and/or semi-resilient materials and a second part 22B constructed from one or more rigid materials and/or resilient materials and/or one or more semi-resilient materials. The second part 22B includes a distal end 22C operationally configured to sealably engage the perimeter member 25 along one or more surfaces. Suitably, the first part 22A is constructed from one or more malleable or flexible materials operationally configured to allow the second clasp 22 to open and close—flexing or bending about its point of attachment to the first member 12. As shown in this example, attached to the inner surface of the second clasp 22 is a plug 52 operationally configured to sealably engage an audio port as understood by the skilled artisan. In operation, the plug 52 suitably forms a seal with the second member 14. which may be provided with an aperture for receiving the plug 52 there through or a cavity for receiving the plug 52 therein.

Figure 11:
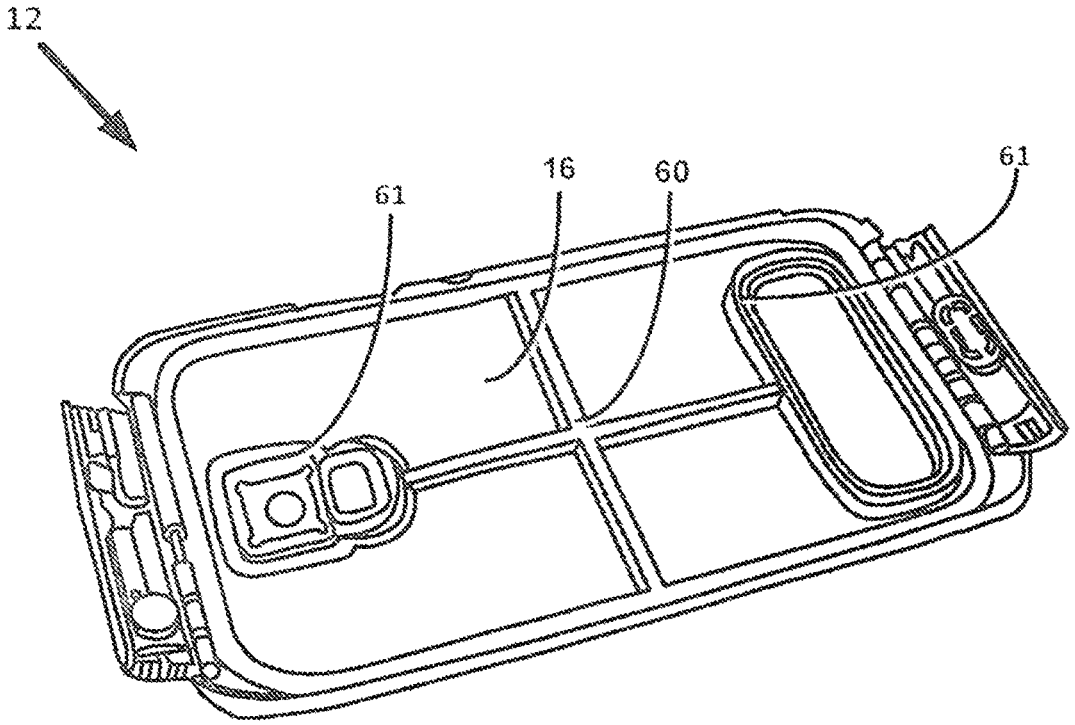
FIG. 11 is another a perspective view of a first member of a protective case.

Turning to FIG. 11, the first member 12 may further include a support frame 60 and one or more raised border surfaces 61 along the perimeter(s) of various smartphone 100 features including, but not necessarily limited to camera lenses, camera flashes, global positioning system ("GPS") antennas, audible receivers and speakers. In addition, the support frame 60 and raised border surfaces 61 suitably provide a support surface for a smartphone 100 whereby a smartphone 100 rests on the support frame 60 and raised border surfaces 61 in a manner effective to maintain distance between the smartphone 100 and the inner surface 16 of the first member 12 during operation of the protective case 10. The support frame 60 and raised border surfaces 61 may be constructed from a similar or dissimilar materials as the first member 12. Suitable raised border surfaces 61 may be constructed from thermoplastic polyurethane ("TPU") and/or thermoplastic elastomers ("TPE"), sometimes referred to as thermoplastic rubbers.

Suitably, the protective case 10 is constructed from one or more materials durable enough to operate as described above regardless the size requirements and weights of objects to he housed therein. More particularly, the protective case 10 may be constructed of materials including but not necessarily limited to those materials resistant to chipping, cracking, excessive bending and reshaping as a result of ozone, weathering, heat, moisture, other outside mechanical and chemical influences, as well as external impacts and other loads placed on the protective case 10. Likewise, the protective case 10 may comprise any color or combination of colors, or in the alternative, the protective case 10 may be transparent, translucent or opaque as desired.

Suitable protective case 10 materials may include rigid and/or semi-rigid and/or resilient and/or semi-resilient materials. Without limiting the invention, suitable materials of construction may include, but are not necessarily limited to metals, woods, plastics, rubbers, ceramics, filled composite materials, carbon fiber, and combinations thereof. Suitable plastics may include, but are not necessarily limited to thermoset plastics and thermoplastics such as polyurethane, polypropylene, polyethylene and copolymers thereof and engineering thermoplastics such as acrylonitrile butadiene styrene (ABS), polycarbonate, polyamides (e.g. Nylon), polysulphone, polybutylene terephthalate (PBT), polyethylene terephthalate (PET). Plastics may also comprise composite materials, for example, plastics with inorganic or organic fillers and/or high aspect ratio reinforcements, e.g., fiberglass, carbon fibers, graphite fibers. Plastics may also be cross-linked by conventional means to control stiffness of the final part. As stated above, thermosets can also be used such as epoxy resins, phenolic resins including composites of these resins with fillers and reinforcements as desired. In one particular embodiment, the protective case 10 may be constructed from thermoplastic polyurethane. Suitable metals may include, but are not necessarily limited to metal alloys such as aluminum, titanium, copper, brass, nickel alloy, stainless steel, carbon steel, and combinations thereof.

Depending on the materials of construction, the protective case 10 may be produced by, for example, 3-D printing technology, assembly of component parts, machining, e.g., via computer numerical control (CNC), blow molding, injection molding, injection blow molding, vacuum forming, thermoforming, and combinations thereof. Also, the various individual protective case 10 parts may be constructed from different materials and/or by using different processes as desired.

Persons of ordinary skill in the art will recognize that many modifications may be made to the present application without departing from the spirit and scope of the application. The embodiment(s) described herein are meant to be illustrative only and should not be taken as limiting the invention, which is defined in the claims.

I claim:

1. A protective case for a portable electronic device, including:

a back cover and a front cover for housing a portable electronic device therein, wherein the back cover and the front cover include one or more mating surfaces operationally configured to fluidly seal the perimeter of the protective case;

wherein the front cover includes a perimeter member and a side member, the perimeter member being constructed from one or more substantially rigid type materials and the side member being constructed from one or more substantially resilient materials;

wherein the back cover includes an outer surface member constructed from one or more non-resilient materials and an inner surface member constructed from one or more resilient materials;

wherein the inner surface member of the back cover includes a channel and wherein the perimeter member of the front cover includes a ridge, the ridge being operationally configured to sealably engage the channel so that a first seal is provided; and, wherein the side member of the front cover includes a face and the outer surface member includes a face so that a second seal is provided via the engagement of the face of the side member with the face of the outer surface member.

2. The protective case of claim 1 wherein the mating surfaces are constructed from one or more resilient materials and one or more non-resilient materials.

3. The protective case of claim 1 including one or more apertures there through operationally configured to work in conjunction with interactive features of an electronic device to be housed in the protective case, the interactive features being selected from the group consisting of speakers, audible receivers, microphones, camera lenses, camera flashes, and combinations thereof.

4. The protective case of claim 1 wherein the mating surfaces are constructed from one or more materials providing one or more compressible mating surfaces and one or more rigid mating surfaces.

5. The protective case of claim 1 wherein the mating surfaces include planar sealable surfaces lying along non-perpendicular and non-parallel planes.

6. The protective case of claim 1 wherein the mating surfaces include planar sealable surfaces lying along a plurality of planes.

7. The protective case of claim 1, the channel being constructed from one or materials operationally configured to form fit the ridge.

8. The protective case of claim 1 wherein the outer surface of the side member includes four or more faces.

9. The protective case of claim 1 wherein the back cover and front cover include one or more corresponding interlocking members along sides of the back cover and front cover operationally configured to assist in fluidly sealing the sides of the protective case and maintain the back cover and front cover in an attached orientation during operation of the protective case.

10. A protective case for a smartphone, including:

a back cover and a front cover for housing a smartphone therein;

wherein the back cover includes an outer surface member constructed from one or more non-resilient materials and an inner surface member constructed from one or more resilient materials;

wherein the front cover includes a perimeter member constructed from one or more non-resilient materials and a side member constructed from one or more substantially resilient materials;

wherein the inner surface member of the back cover includes a channel and wherein the perimeter member of the front cover includes a ridge, the ridge being operationally configured to sealably engage the channel so that a first seal is provided; and, wherein the side member of the front cover includes a face and the outer surface member includes a face so that a second seal is provided via the engagement of the face of the side member with the face of the outer surface member.

11. The protective case of claim 10 wherein the protective case includes at least six sealable surfaces defining points of engagement between the front cover and back cover.

12. The protective case of claim 11 further including at least one sealable surface defining a point of engagement between the back cover and a smartphone housed within the protective case.

13. A method of isolating an electronic device from ambient fluids, including:

providing a protective case for sealably housing an electronic device therein, the protective case having a back cover and a front cover with one or more mating surfaces operationally configured to fluidly seal the perimeter of the protective case when housing an electronic device therein;

placing an electronic device between the back and front covers and locking the back cover to the front cover;

wherein the front cover includes a perimeter member and a side member, the perimeter member being constructed from one or more substantially rigid type materials and the side member being constructed from one or more substantially resilient materials;

wherein the back cover includes an outer surface member constructed from one or more non-resilient materials and an inner surface member constructed from one or more resilient materials;

wherein the inner surface member of the back cover includes a channel and wherein the perimeter member of the front cover includes a ridge, the ridge being operationally configured to sealably engage the channel so that a first seal is provided; and, wherein the side member of the front cover includes a face and the outer surface member includes a face so that a second seal is provided via the engagement of the face of the side member with the face of the outer surface member.

* * * * *